United States Patent [19]

Kale

[11] Patent Number: 4,793,853

[45] Date of Patent: Dec. 27, 1988

[54] APPARATUS AND METHOD FOR FORMING METAL POWDERS

[76] Inventor: Sadashiv S. Kale, 980 Sunset Rd., Piscataway, N.J. 08854

[21] Appl. No.: 154,152

[22] Filed: Feb. 9, 1988

[51] Int. Cl.[4] ..... B22F 9/08

[52] U.S. Cl. ..... 75/0.5 C; 425/7; 264/12

[58] Field of Search ..... 75/0.5 C; 425/7; 264/12

[56] References Cited

U.S. PATENT DOCUMENTS

| | | | |
|---|---|---|---|
| 3,658,311 | 4/1972 | DiGiambattista et al. | 266/34 R |
| 3,663,206 | 5/1972 | Lubanska | 75/60 |
| 3,695,795 | 10/1972 | Jossick | 425/7 |
| 4,011,290 | 3/1977 | Blomqvist et al. | 264/12 |
| 4,124,377 | 11/1978 | Larson | 75/0.5 C |
| 4,177,026 | 12/1979 | Honnorat et al. | 425/7 |
| 4,233,007 | 11/1980 | Karlsson | 425/7 |
| 4,233,062 | 11/1980 | Siddall | 75/0.5 C |
| 4,376,740 | 3/1983 | Uda et al. | 264/10 |
| 4,502,885 | 3/1985 | Cheney | 75/0.5 B |
| 4,544,404 | 10/1985 | Yolton et al. | 75/0.5 C |
| 4,610,719 | 9/1986 | Wentzell | 75/0.5 C |
| 4,626,278 | 12/1986 | Kenney et al. | 75/0.5 C |

*Primary Examiner*—Wayland Stallard
*Attorney, Agent, or Firm*—Kenyon & Kenyon

[57] ABSTRACT

An apparatus and method for forming metal powders in which a stream of atomized molten metal is expelled substantially horizontally within a sealed chamber containing a non-reactive gas under pressure, and permitted to free-fall in an arcuate path through the chamber. Atomization is accomplished by use of a nozzle device in which a forced stream of molten metal is cut into droplets by a spiraling jet of the non-reactive gas.

24 Claims, 4 Drawing Sheets

10
12
13
21
22
23
24
25
26
27
28
29
30
31
32
33
34
35
36
4
4

APPARATUS AND METHOD FOR FORMING METAL POWDERS

BACKGROUND OF THE INVENTION

1. Field of the Invention

This invention relates to an apparatus and a method for forming spherical and uniform metal powder particles wherein the apparatus is arranged in a substantially horizontal layout.

2. Description of the Related Art

It is well known in the art to produce powdered metal by atomizing a molten metal stream and permitting the molten metal droplets thereby formed to cool by falling freely within a chamber. Subsonic nozzles used for atomization in the art have been found to impart a cooling rate to the metal droplets that is insufficient to solidify the droplets in a short distances of travel. Thus, the droplets require longer distance of travel in the chambers, without any significant surface impact, to solidify and retain sphericity. This essentially puts a lower limit on the height of the atomization tower used.

Experience has shown that extending the height through which the droplets fall, and thus prolonging the time the droplets are resident within the cooling chamber, produces metal powder particles of greater sphericity and uniformity.

Metal powder forming apparatus in which tall cooling chambers are employed are common in the art. For example, U.S. Pat. No. 4,233,007 discusses an experimental apparatus employing a chamber eight meters high. (See col. 6, 1.57-col. 8, 1.19) While the use of such an apparatus can yield metal powder particles of satisfactory sphericity and uniformity, the significant height of the cooling chamber required imposes space demands not easily met even within buildings adapted for heavy industrial uses, much less smaller commercial structures.

Accordingly, various attempts have been made in the art to produce satisfactory metal powders using cooling chambers of reduced height. One such approach is disclosed in the aforementioned U.S. Pat. No. 4,233,007, wherein it is suggested that use of a fluidized bed at the lower end of the atomizing chamber will artificially extend the residence time of the granules within the chamber and lower the required height of the chamber.

An alternative approach to extending residence, or suspension, time within the chamber is exemplified by U.S. Pat. No. 3,695,795, in which the residence time required is reduced by causing a more rapid transfer of heat from the atomized droplets. The patent discloses a miniaturized apparatus for producing powdered metal in which a molten metal stream falls through a secondary chamber supplied with cooling gas before passing through an atomizing nozzle and into the main cooling vessel. The nozzle used in the apparatus includes a series of baffles which are placed to impart a swirling motion to the atomizing gas striking the falling metal stream. The velocity of the atomizing gas produces a region of low pressure at the entry point of the molten metal stream into the main cooling chamber, thereby inducing a flow of gas from the secondary cooling chamber through the atomizing nozzle along with the stream of molten metal. The resultant large volume of cooling gas to which the molten stream is exposed produces rapid cooling, thus reducing required residence time in the cooling chamber and permitting a smaller chamber to be used.

While the foregoing prior art approaches have apparently reduced the required height of the cooling chamber, they possess certain drawbacks, including, increased complexity and consequent increased likelihood of failure and need for maintenance. Further, the production of countercurrent flow in the chamber to increase residence time, or the introduction of secondary cooling gas in order to increase the total volume of gas to which the metal powder is exposed add energy, and thus cost, requirements over simple free-fall atomization chambers.

SUMMARY OF THE INVENTION

The present invention addresses the deficiencies of existent metal powder forming apparatus and methods utilizing elongated vertical atomizing chambers, and achieves superior results without increasing complexity or cost. The invention comprises an apparatus and method for forming metal powders in which an atomized metal stream is expelled in a substantially horizontal direction into a pressurized cooling chamber and permitted to free-fall in a arcuate path through a height significantly less than that which is characteristic of the well-known vertical cooling chambers in the prior art.

Atomization of the molten metal is accomplished by use of a nozzle arrangement in which a stream of molten metal is expelled from a conduit disposed along the axis of the nozzle and is struck by at least one rotating jet of a pressurized non-reactive gas, such as nitrogen. The jet of gas is created by a groove formed in the peripheral surface of a wheel which is rotatably mounted on the molten metal conduit near the outlet end thereof. The conduit and wheel are mounted within a generally cylindrical housing which tapers at one end to provide an exit through which the atomized metal is ejected. The tapered section of the housing closely follows the beveled surface of the wheel so as to restrict any flow of gas toward the housing exit to the groove formed in the periphery of the wheel. An inlet port for compressed gas from an external source is formed in the housing.

Inasmuch as the groove formed in the periphery of the wheel is S-shaped, the passage of pressurized gas through the groove imparts a spinning motion to the wheel, thu imparting a spiralling motion to the jet of gas directed at the stream of molten metal. The spiralling jet of gas cuts the stream of molten metal into droplets, which emerge at a relatively high velocity from the nozzle exit and are cooled within the pressurized atmosphere of the chamber by falling in an arcuate path toward hoppers located at the bottom of the chamber. The spiraling gas jet also imparts a spinning motion to the molten droplets, promoting the formation of uniform spherical particles.

The horizontal apparatus and process of the invention eliminates the need for high ceiling heights such as are found in buildings designed for heavy industrial uses. The invention also eliminates the need to use overhead cranes or other large machinery in dissembling and reassembling the apparatus, making the process simple, versatile, and inexpensive. The invention is thus easily adapted for use in a small, cottage-type industry.

BRIEF DESCRIPTION OF THE DRAWINGS

The invention may be best understood by reference to the following description of the preferred embodiment and the accompanying drawings, in which.

DESCRIPTION OF THE PREFERRED EMBODIMENT

Figure 1:
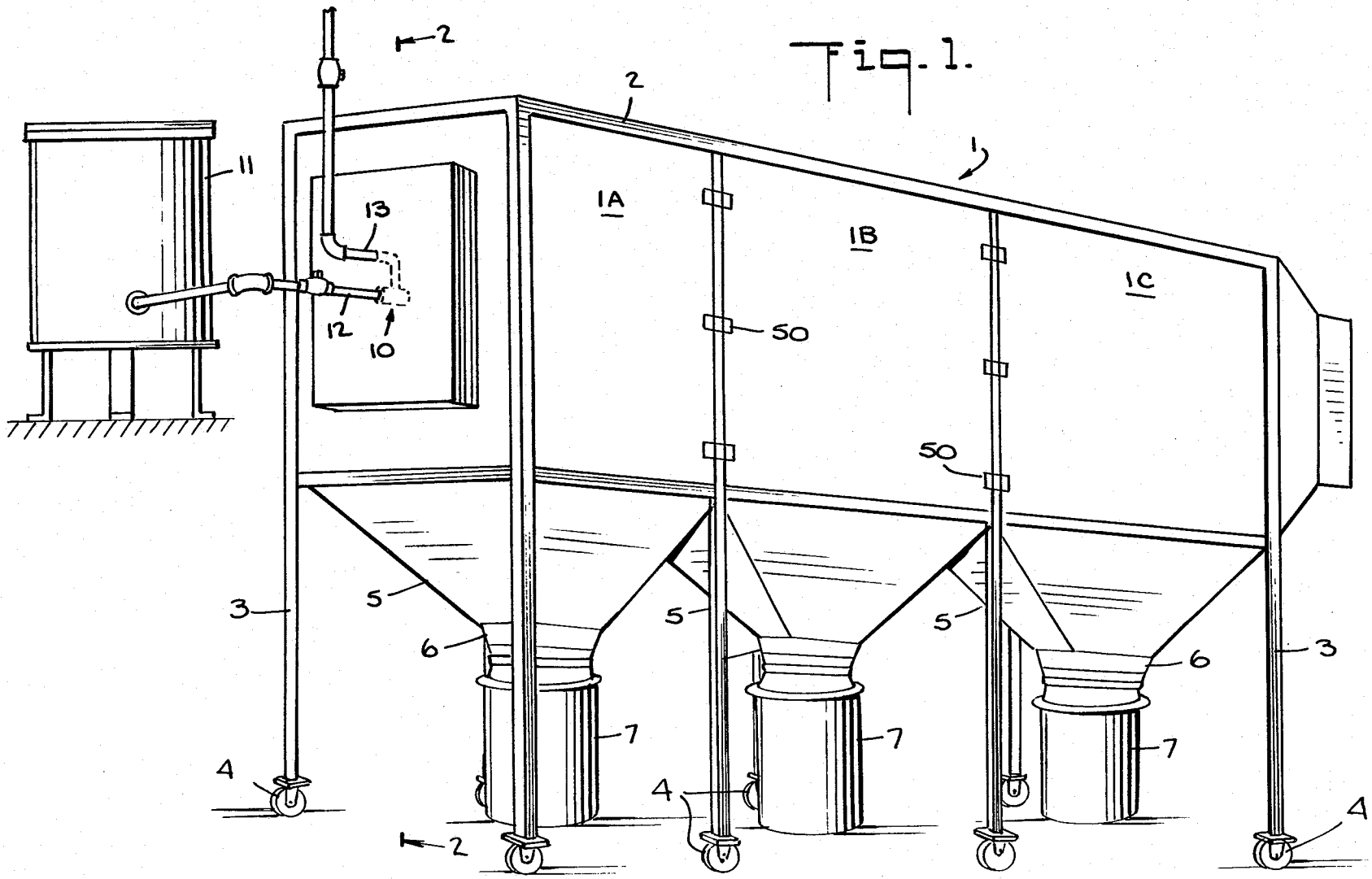
FIG. 1 is an overall view in perspective of a metal powder forming apparatus in accordance with the invention.

With reference to FIG. 1, a generally rectangular enclosure 1, constructed so that its longest dimension is oriented horizontally, is shown. The enclosure is composed of individual segments 1A, 1B and 1C held together by suitable fastening means 50, each of which segments is supported by a frame 2 which includes vertical legs 3. Legs 3 may be mounted on wheels 4, as shown, to facilitate movement of the enclosure as a whole and each segment thereof. Segmentation of the enclosure permits separation into discrete units for cleaning or transportation.

Thus, small batch sizes of different powders can be produced efficiently. Whereas in vertical atomization processes it is difficult to switch from one material to another, or to clean the cooling chamber quickly, due to their rigid and clumsy construction, in this invention the components of the apparatus can be easily and quickly detached, rolled off site for cleaning, and reassembled to receive a different material.

The lower portion of the enclosure includes a number of hoppers 5 each of which tapers to a conical section 6 through which the contents of the hoppers are discharged. When the apparatus of the invention is in use, containers 7 are disposed below the discharge sections of each of the hoppers to receive te contents thereof.

For reasons which will become apparent hereinafter, a hermetic sealing arrangement is employed between the outlet of each of discharge sections 6 and the open end of each of containers 7. A suitable seal would be formed, for example, by including within containers 7 a gas impervious liner, the open end of which would be fastened around the periphery of discharge section 6 with any suitable means, such as an elastic or steel band.

Figure 2:
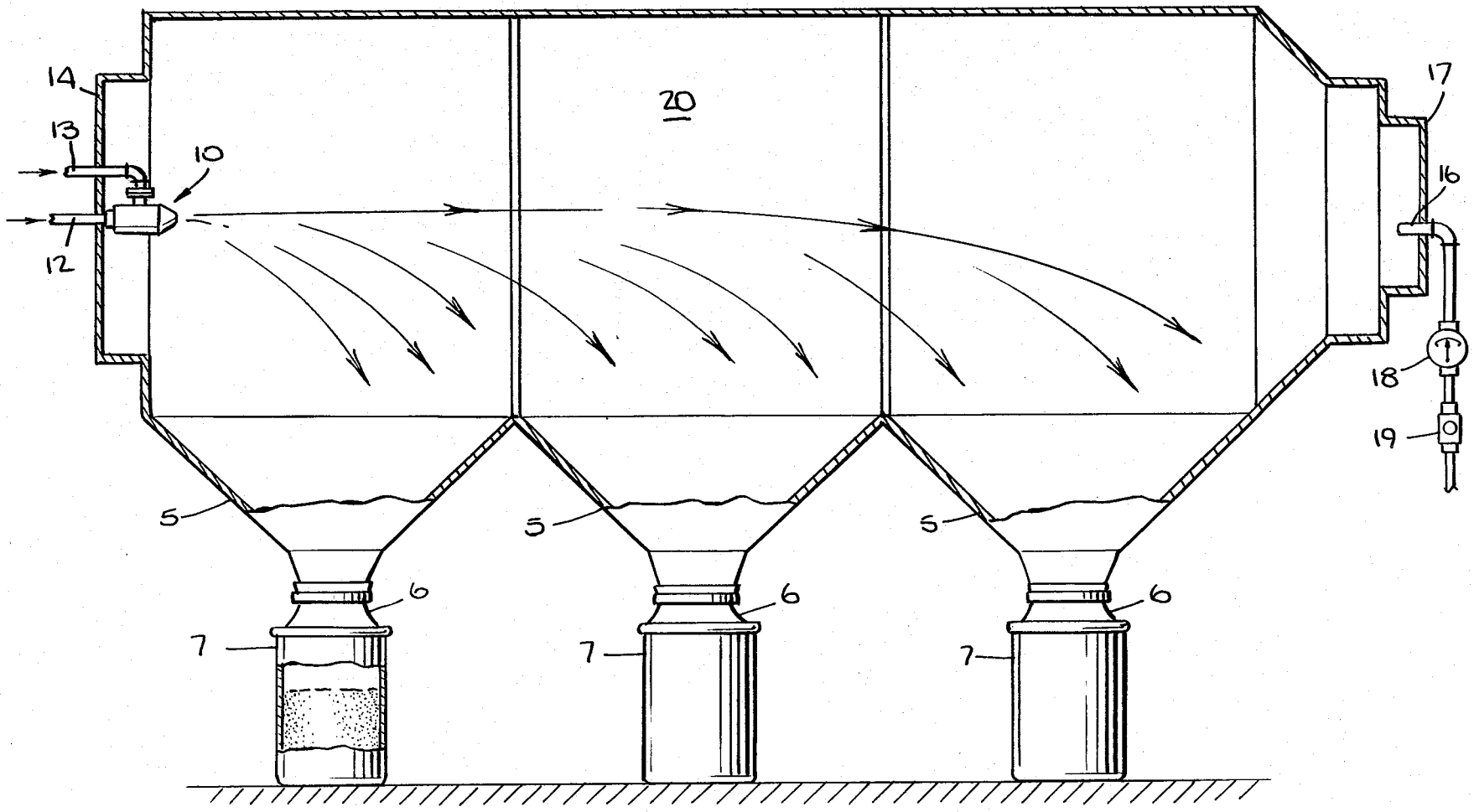
FIG. 2 is a cross-sectional elevation, taken along line 2—2 of FIG. 1.

Referring to FIGS. 1 and 2, mounted in one end of enclosure 1 is an atomizing nozzle 10 which receives a supply of molten metal from a furnace 11 through a conduit 12. A second conduit 13 supplies a non-reactive cooling gas, such as nitrogen, under pressure to the nozzle. The nozzle is mounted so that it lies entirely within a chamber formed by the walls of enclosure 1. Conduits 12 and 13 enter the chamber through apertures formed in the end wall 14 of the enclosure. Suitable means, such as a metal adhesive are employed to hermetically seal the space between the exterior surfaces of conduits 12 and 13 and the periphery of the apertures formed in end wall 14.

The sealing around conduits 12 and 13, and the sealing of the space between discharge sections 6 of hoppers 5 and containers 7, as previously described, permit the build up of a positive gas pressure within chamber 20. Mounted at the end of enclosure 1 opposite end wall 14 is a third conduit 16 which passes through an aperture in end wall 17 of the enclosure. Conduit 16 permits passage of gas within the chamber to a suitable pressure gauge 18 which permits monitoring of the gas pressure within chamber 20. Downstream of pressure gauge 18 is a relief valve 19 which permits the escape of gas and reduction of excess pressure within chamber 20.

Figures 3, 4, 5:
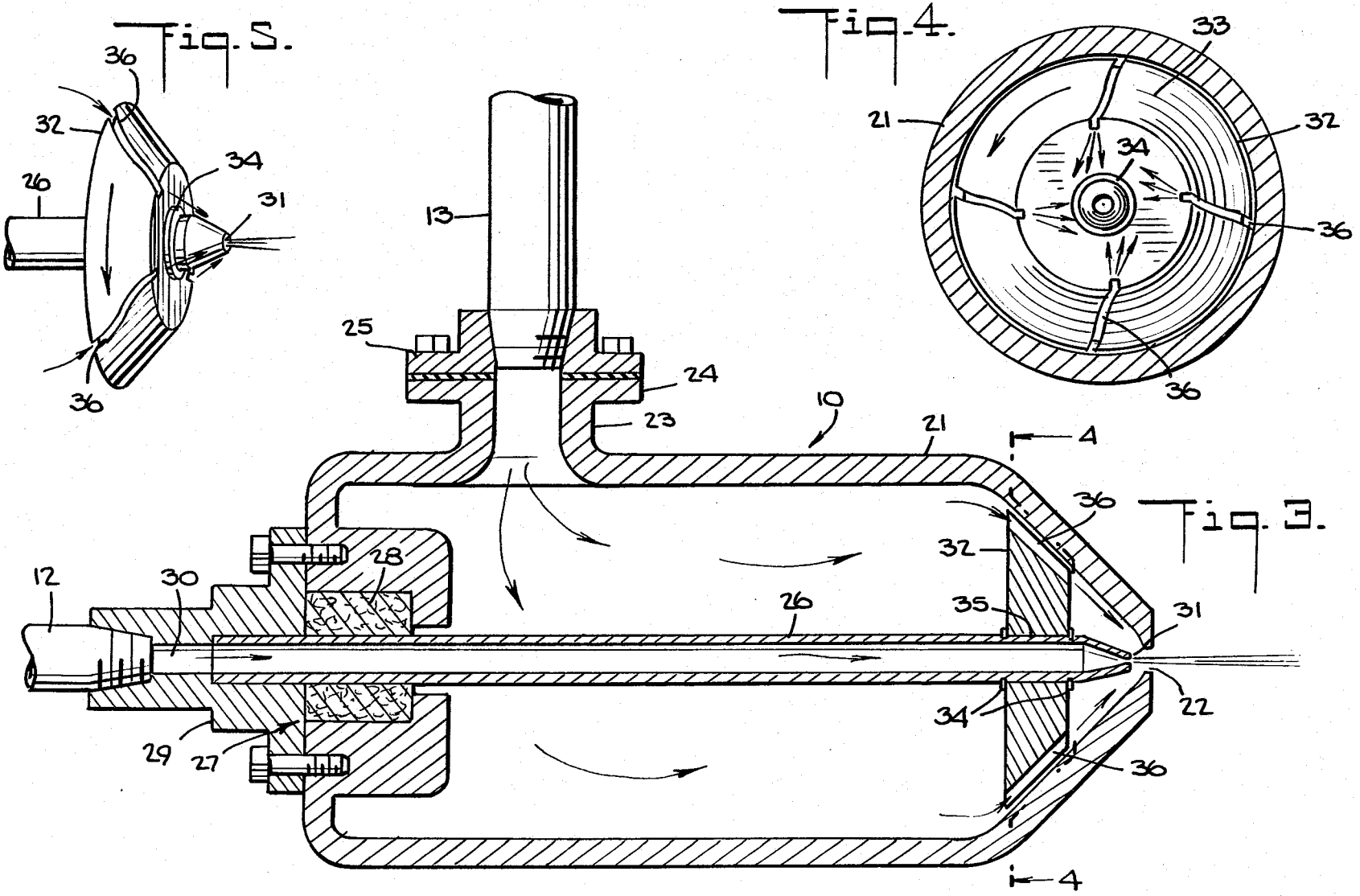
FIG. 3 is an enlarged cross-section of the atomizing nozzle used in the preferred embodiment of the invention.
FIG. 4 is an enlarged cross-section of the atomizing nozzle taken along line 4—4 of FIG. 3.
FIG. 5 is a perspective view of a portion of the atomizing nozzle of FIGS. 3 and 4.

With reference to FIGS. 2 and 3, nozzle 10 accomplishes the mixture of pressurized gas with a stream of molten metal supplied by furnace 11 in such a manner as to cause atomization of the molten metal into relatively fine droplets which fall through the chamber in an arcuate path toward hoppers 5. As the molten metal droplets fall, they are cooled to form solid particles of metal powder, which are collected in hoppers 5 and discharged into containers 7. The entry of pressurized gas from conduit 13 through nozzle 10 causes a build-up of gas pressure within chamber 20, which pressure is regulated by relief valve 19.

The structure and operation of nozzle 10 is best understood with reference to FIGS. 3–5. Nozzle 10 includes a generally cylindrical housing 21 which tapers conically at one end to form an exit opening 22. The upper portion of the nozzle includes an inlet section 23 with an integrally formed flange 24. Fastened to flang 24 is a cap 25 with a central opening for receiving the tapered end of gas conduit 13. A suitable sealing means such as a gasket is employed between flange 24 and cap 25 to prevent escape of the gas.

Positioned within housing 21 along the central axis of the nozzle is a hollow spindle 26 which extends at one end through an opening 27 in housing 21 opposite exit 22. Seated within open 27 and around the periphery of spindle 26 is a gland 28 which both provides support for spindle 26 and seals opening 27 from the escape of gas entering the housing through conduit 13. Covering open 27 is a cap 29 which includes a centrally located opening 30 having a recess for receiving one end of spindle 26.

Opening 30 also includes at its end opposite the portion of cap 29 abutting opening 27 a tapered portion which receives an end of conduit 12. Alternatively, opening 30 may be provided with screw threads to receive a threaded end of conduit 12. Cap 29 is fastened to housing 21 by any suitable means such as machine screws.

The end of spindle 26 opposite cap 29 tapers conically to form an outlet 31 of reduced diameter through which molten metal supplied through conduit 12 is forced. The reduced diameter of outlet 31 will cause the molten metal supplied through the central hollow of spindle 26 to be expelled from outlet 31 as a narrow stream.

Positioned axially on spindle 26 near its conically tapered end is a rotatable wheel 32 having a beveled surface 33 which closely abuts the interior surface of the tapere portion of housing 21. Wheel 32 is maintained in position along spindle 26 shown in FIG. 3 by a pair of bearings 34. The diameter of bore 35 of wheel 32 is sufficiently greater than the outer diameter of spindle 26 to permit free rotation of wheel 32.

Cut into the periphery of the beveled surface 33 of wheel 32 are a number of S-shaped grooves 36 which permit the egress of compressed gas within the nozzle toward exit 22. As previsouly indicated, beveled surface 33 closely abuts the inner surface of the conically tapered portion of nozzle housing 21. Thus, most of the flow of gas around wheel 32 is constrained to follow grooves 36. The change in direction imposed on the flow of gas by the S-shape of grooves 36 produces a reactive force along the walls of the grooves, thus imparting a spinning motion to wheel 32. As a result, the flow of gas emerging from each of grooves 36 issues as a spiraling jet.

The position of wheel 32 and the angle of its beveled surface 33 are selected so that the gas jets issuing from grooves 36 are directed at the molten metal stream expelled from spindle 26 just inside nozzle exit 22. The force of the spiraling gas jets impacting on the molten metal stream cause the stream to emerge from exit 22 as a spray of generally spherical droplets.

The use of the apparatus of the invention to produce a metal powder is superior properties will now be described. In this example, tin powder is produced. However, it should be understood that saiisfactory powders of other metals and metal alloys may be produced using the apparatus of the invention in the manner hereinafter described.

EXAMPLE

Figure 6:
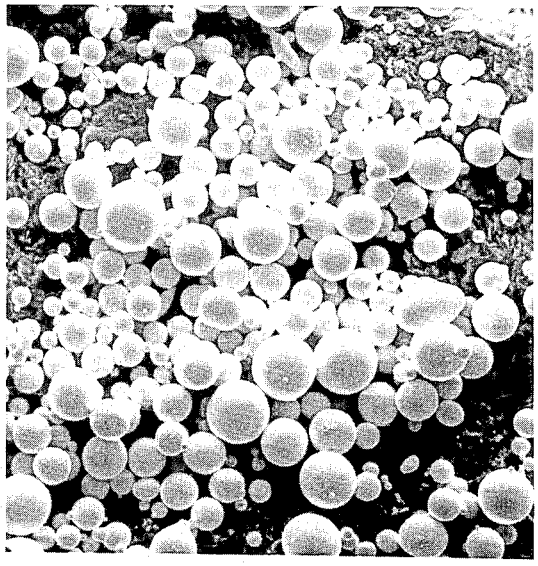
FIG. 6 is a photomicrograph of metal powder particles formed by utilizing the apparatus and process of the invention.

Ingots of 63% tin solder were melted down in furnace 11, and the molten tin at a temperature of approximately 650° F. was supplied to the nozzle through conduit 12. Simultaneously, nitrogen at a temperature of approximately 100° F. was supplied to nozzle 10 through conduit 13 at a pressure of approximately 100 psi. The pressure within chamber 20 was allowed to build to approximately two pounds psi and thereafter maintained at that pressure for the entirety of the run, which lasted for approximately 3½ hrs. After the run was terminated, the sample was removed from one of the containers 7 for microscopic analysis. FIG. 6 shows a photomicrograph of the sample at a magnification of 250x. The sample powder shown exhibits uniform spherical shape throughout, and a relatively uniform distribution of particle sizes between 200 and 400 U.S. mesh size.

It will be understood that the parameters of the process of the invention will vary within certain ranges, depending upon the metal powders to be produced. In particular, pressure of the cooling gas supplied to the nozzle will be within the ranges of 50 psi and 250 psi, for optimal results. The pressure within chamber 20 may also vary within the range of approximately 1.5 to 6.5 atmospheres above atmospheric pressure. Cooling gases other than nitrogen which are also non-reactive with the molten metal, such as argon and helium, may also be used.

What is claimed is:

1. An apparatus for forming metal powders comprising:

means defining a sealed chamber for containing a gas under pressure;

means for regulating the gas pressure within said chamber;

means for atomizing molten metal and for expelling said atomized metal within said chamber in a substantially horizontal direction, wherein said atomized metal falls in an arcuate path within said chamber and solidifies to form metal particles; and means for accumulating said metal particles.

2. An apparatus in accordance with claim 1 wherein said means defining a sealed chamber comprises a plurality of detachably connected segments.

3. An apparatus in accordance with claim 1 wherein said atomizing means comprises:

means for expelling a stream of said molten metal in a substantially horizontal direction;

means for directing at least one jet of pressurized gas at said stream; and means for rotating said jet about an axis aligned with said stream.

4. An apparatus in accordance with claim 3 wherein said jet of pressurized gas is directed at said molten metal at an angle less than 90 degrees.

5. An apparatus in accordance with claim 4 wherein:

said stream expelling means comprises a substantially cylindrical conduit having a central axis and having one end coupled to a source of molten metal, an opposite end forming an outlet for said stream, said outlet having a first cross-sectional area, and an intermediate section having a second cross-sectional area greater than said first cross-sectional area.

6. An apparatus in accordance with claim 5 wherein:

said atomizing means includes a housing surrounding said stream expelling means, wherein said housing includes an end portion having a tapered interior surface, said end portion including an exit aligned with said outlet of said stream forming means.

7. An apparatus in accordance with claim 6 wherein:

said means for rotating said jet of pressurized gas includes a wheel rotatably mounted on said stream expelling means adjacent the outlet end thereof and having an axis of rotation aligned with the axis of said stream expelling means, said wheel being surrounded by the tapered portion of said housing and having a beveled peripheral surface which closely follows the tapered interior surface of said housing; and said jet directing means is formed in said wheel.

8. An apparatus in accordance with claim 7 wherein:

said housing includes inlet means for receiving a gas under pressure;

said wheel is mounted intermediate said inlet means and said exit end of said housing; and said jet directing means comprises at least one groove formed in the peripheral surface of said wheel.

9. An apparatus in accordance with claim 8 wherein:

said groove is substantially S-shaped, whereby the passage of said pressurized gas through said groove inparts rotational motion to said wheel.

10. A device for atomizing molten metal comprising:

means for expelling a stream of molten metal;

means for directing at least one jet of pressurized gas at said stream; and means for rotating said jet about an axis aligned with said stream.

11. An apparatus in accordance with claim 10 wherein said jet of pressurized gas is directed at said molten metal at an angle less than 90 degrees.

12. An apparatus in accordance with claim 11 wherein:

said stream expelling means comprises a substantially cylindrical conduit having a central axis and having one end coupled to a source of molten metal, an opposite end forming an outlet for said stream, said outlet having a first cross-sectional area, and an intermediate section having a second cross-sectional area greater than said first cross-sectional area.

13. An apparatus in accordance with claim 12 wherein:

said atomizing means includes a housing surrounding said stream expelling means, wherein said housing includes an end portion having a tapered interior surface, said end portion including an exit aligned with said outlet of said stream forming means.

14. An apparatus in accordance with claim 13 wherein:

said means for rotating said jet of pressurized gas includes a wheel rotatably mounted on said stream expelling means adjacent the outlet end thereof and having an axis of rotation aligned with the axis of said stream expelling means, said wheel being surrounded by the tapered portion of said housing and having a beveled peripheral surface which closely follows the tapered interior surface of said housing; and said jet directing means is formed in said wheels.

15. An apparatus in accordance with claim 14 wherein:

said housing includes inlet means for receiving a gas under pressure;

said wheel is mounted intermediate said inlet means and said exit end of said housing; and said jet directing means comprises at least one groove formed in the peripheral surface of said wheel.

16. An apparatus in accordance with claim 15 wherein:

said groove is substantially S-shaped, whereby the passage of said pressurized gas through said groove inparts rotational motion to said wheel.

17. A method for forming metal powders comprising the steps of:

introducing a non-reactive gas under pressure into a sealed chamber;

maintaining the gas pressure within said chamber in the range of 1.5 to 6.5 atmospheres;

atomizing a molten metal and expelling said atomized metal within said chamber in a substantially horizontal direction, wherein said atomized metal falls in an arcuate path within said chamber and solidifies to form metal particles; and accumulating said metal particles.

18. A method in accordance with claim 17 wherein said step of atomizing a molten metal and expelling said atomized metal includes:

expelling a stream of said molten metal in a substantially horizontal direction;

directing at least one jet of said non-reactive gas at said stream; and rotating said jet about an axis aligned with said stream.

19. A method in accordance with claim 18 wherein said jet of non-reactive gas is directed at said molten metal stream at an angle less than 90 degrees.

20. A method in accordance with claim 19 wherein said non-reactive gas is nitrogen.

21. A method in accordance with claim 19 wherein said non-reactive gas is argon.

22. A method in accordance with claim 19 wherein said non-reactive gas is helium.

23. A method in accordance with claim 18 wherein said jet of non-reactive gas is at a pressure in the range of 50 psi to 250 psi.

24. A method in accordance with claim 23 wherein the height through which said atomized metal falls within said chamber is in the range of three to five feet.

* * * * *